US009968161B2

(12) United States Patent
Humphrey et al.

(10) Patent No.: US 9,968,161 B2
(45) Date of Patent: May 15, 2018

(54) SHOE CONSTRUCTIONS HAVING UPPER ASSEMBLIES WITH INDEPENDENTLY MOVABLE BOOTIES AND DECOUPLED SOLE ASSEMBLIES

(71) Applicant: Brooks Sports, Inc., Seattle, WA (US)

(72) Inventors: Pete Humphrey, Mill Creek, WA (US); Eric Rohr, Seattle, WA (US); Zachary Richard Adam Boteilho, Seattle, WA (US)

(73) Assignee: Brooks Sports, Inc., Seattle, WA (US)

( * ) Notice: Subject to any disclaimer, the term of this patent is extended or adjusted under 35 U.S.C. 154(b) by 0 days. days.

(21) Appl. No.: 15/167,910

(22) Filed: May 27, 2016

(65) Prior Publication Data

US 2016/0345673 A1 Dec. 1, 2016

Related U.S. Application Data

(60) Provisional application No. 62/167,722, filed on May 28, 2015.

(51) Int. Cl.

| | |
|---|---|
| ***A43B 23/00*** | (2006.01) |
| ***A43B 23/02*** | (2006.01) |
| ***A43C 1/04*** | (2006.01) |
| ***A43B 13/12*** | (2006.01) |
| ***A43B 23/07*** | (2006.01) |
| ***A43B 23/08*** | (2006.01) |
| ***A43B 13/14*** | (2006.01) |
| ***A43B 23/16*** | (2006.01) |
| ***A43C 11/00*** | (2006.01) |
| ***A43C 19/00*** | (2006.01) |

(52) U.S. Cl.

CPC ..... *A43B 23/026* (2013.01); *A43B 13/125* (2013.01); *A43B 13/141* (2013.01);

(Continued)

(58) Field of Classification Search

CPC ... A43B 23/026; A43B 23/0245; A43B 23/16; A43C 1/04; A43C 11/00; A43C 11/004; A43C 19/00

(Continued)

(56) References Cited

U.S. PATENT DOCUMENTS 5,271,130 A * 12/1993 Batra ..... A43B 23/0235 24/714.6
5,499,459 A * 3/1996 Tomaro ..... A43B 1/0045 36/10

(Continued)

FOREIGN PATENT DOCUMENTS

DE 20313763 U1 12/2003
EP 1444909 A1 8/2004

(Continued)

OTHER PUBLICATIONS

International Searching Authority, International Search Report and Written Opinion, PCT Application PCT/US2016/034871, dated Oct. 24, 2016, 22 pages.

*Primary Examiner* — Ted Kavanaugh
(74) *Attorney, Agent, or Firm* — Perkins Coie LLP

(57) ABSTRACT

Shoe constructions having upper assemblies with independent booties and/or decoupled sole assemblies are disclosed herein. A shoe configured in accordance with embodiments of the present technology can include, for example, an upper assembly attached to a sole assembly. The upper assembly can include a throat portion defining an opening configured to receive a foot and a bootie attached the overlay primarily at the throat portion. The bootie can be movable relative to the remaining portion of the upper assembly and the sole assembly. The sole assembly can include a midsole and an outsole that together define a first portion in a forefoot region of the shoe and a second portion in a heel region of the shoe. The first portion and second portions can be decoupled from each other. The midsole can include a stability plate that provides medial and lateral stability to the sole assembly.

25 Claims, 5 Drawing Sheets

(52) U.S. Cl.
CPC ..... *A43B 23/0245* (2013.01); *A43B 23/07* (2013.01); *A43B 23/088* (2013.01); *A43B 23/16* (2013.01); *A43C 1/04* (2013.01); *A43C 11/00* (2013.01); *A43C 11/004* (2013.01); *A43C 19/00* (2013.01)

(58) Field of Classification Search
USPC ..... 36/10, 45, 50.1
See application file for complete search history.

(56) References Cited

U.S. PATENT DOCUMENTS

| | | | | |
|---|---|---|---|---|
| 5,964,047 | A * | 10/1999 | Covatch | A43B 7/34 36/10 |
| 6,467,193 | B1 | 10/2002 | Okajima et al. | |
| 2004/0181972 | A1 | 9/2004 | Csorba | |
| 2009/0090027 | A1 | 4/2009 | Baudouin | |
| 2012/0011744 | A1 | 1/2012 | Bell et al. | |
| 2013/0031801 | A1 * | 2/2013 | Hatfield | A43B 3/24 36/83 |
| 2013/0212909 | A1 * | 8/2013 | Bates | A43B 13/189 36/102 |
| 2014/0360048 | A1 | 12/2014 | Vanatta et al. | |
| 2015/0313316 | A1 * | 11/2015 | Boucher | A43B 23/0215 36/93 |

FOREIGN PATENT DOCUMENTS

| | | | |
|---|---|---|---|
| EP | 1486131 | A1 | 12/2004 |
| EP | 2433515 | A2 | 3/2012 |
| FR | 2999881 | A1 | 6/2014 |

* cited by examiner

SHOE CONSTRUCTIONS HAVING UPPER ASSEMBLIES WITH INDEPENDENTLY MOVABLE BOOTIES AND DECOUPLED SOLE ASSEMBLIES

CROSS-REFERENCE TO RELATED APPLICATIONS

This application claims priority to and the benefit of U.S. Provisional Patent Application No. 62/167,722, titled SHOE CONSTRUCTIONS HAVING UPPER ASSEMBLIES WITH INDEPENDENTLY MOVABLE BOOTIES AND DECOUPLED SOLE ASSEMBLIES, filed May 28, 2015, which is herein incorporated by reference in its entirety.

TECHNICAL FIELD

The present technology is related to footwear and footwear constructions.

BACKGROUND

Athletic shoes protect and support athletes' feet while performing athletic activities. Running shoes, for example, are typically cushioned to protect the runner's feet from the underlying terrain and to absorb some of the shock that occurs when the runner's foot strikes the ground. Without proper fit, support, and cushioning, the runner's foot, ankle, calf, knee, and even hip joints may be challenged physically by the athletic activity. Inserts, such as orthotics and other shaped insoles, are often added to running shoes to provide arch support or to otherwise try to enhance the fit of the shoe to the athlete's foot. The soles of many running shoes also include stability features designed to correct for perceived deficiencies in runners' gaits and to facilitate proper alignment of joints, bones, and muscles of the foot, leg, and hip while running. For example, running shoes include varying degrees of support on the medial and lateral sides of the sole to help guide or control mild, moderate, or severe overpronation (i.e., the motion of the foot rolling excessively inward through the foot strike) or supination (i.e., the motion of the foot rolling outward through the foot strike). Such increases in the medial and lateral stability of a shoe often times compromise the flexibility of the shoe sole. There has also been a trend toward barefoot or natural running shoes that have very thin soles and little to no support or cushioning. Accordingly, there is a need to provide an athletic shoe that provides a supportive fit around the athlete's foot, while still maintaining flexibility in the sole and providing a lightweight shoe.

BRIEF DESCRIPTION OF THE DRAWINGS

Many aspects of the present technology can be better understood with reference to the following drawings. The components in the drawings are not necessarily to scale. Instead, emphasis is placed on illustrating clearly the principles of the present technology. For ease of reference, throughout this disclosure identical reference numbers may be used to identify identical or at least generally similar or analogous components or features.

DETAILED DESCRIPTION

Aspects of the present disclosure are directed generally toward shoes that include an upper assembly with an exterior layer, an independently movable internal bootie, and/or a decoupled sole assembly, and toward associated methods of manufacture. In various embodiments of the present technology, a shoe can include, for example, an upper assembly having an exterior layer, a bootie attached only at a throat portion of the shoe and a sole assembly coupled to the upper assembly. The upper assembly can include a strapping assembly that extends around the bootie and is configured to snugly cinch the bootie around a wearer's full foot substantially independent of the upper assembly's exterior layer. In certain embodiments, a forefoot portion of the sole assembly can be decoupled from a heel portion of the sole assembly to impart flexibility to the shoe.

Certain details are set forth in the following description and in FIGS. 1-8 to provide a thorough understanding of various embodiments of the disclosure. One skilled in the art, however, will understand that the present technology may have additional embodiments, and that other embodiments of the technology may be practiced without several of the specific features described below, while still other embodiments of the disclosure may be practiced with additional details and/or features. For example, many of the shoe constructions described below refer to running shoes. However, in other embodiments the shoe constructions disclosed herein may be used for different types of athletic shoes or other shoe constructions. Other details describing well-known structures and components often associated with shoe constructions, shoe upper assemblies, and sole assemblies, however, are not set forth below to avoid unnecessarily obscuring the description of various embodiments of the disclosure. In addition, the terms "athlete" and "runner" as used herein should be construed broadly to include human subjects in general. Embodiments of the Applicant's technology are discussed below with reference to athletes or runners, although the technology can be used in connection with other individuals who may not be considered athletes, runners, or athletic.

Figure 1:
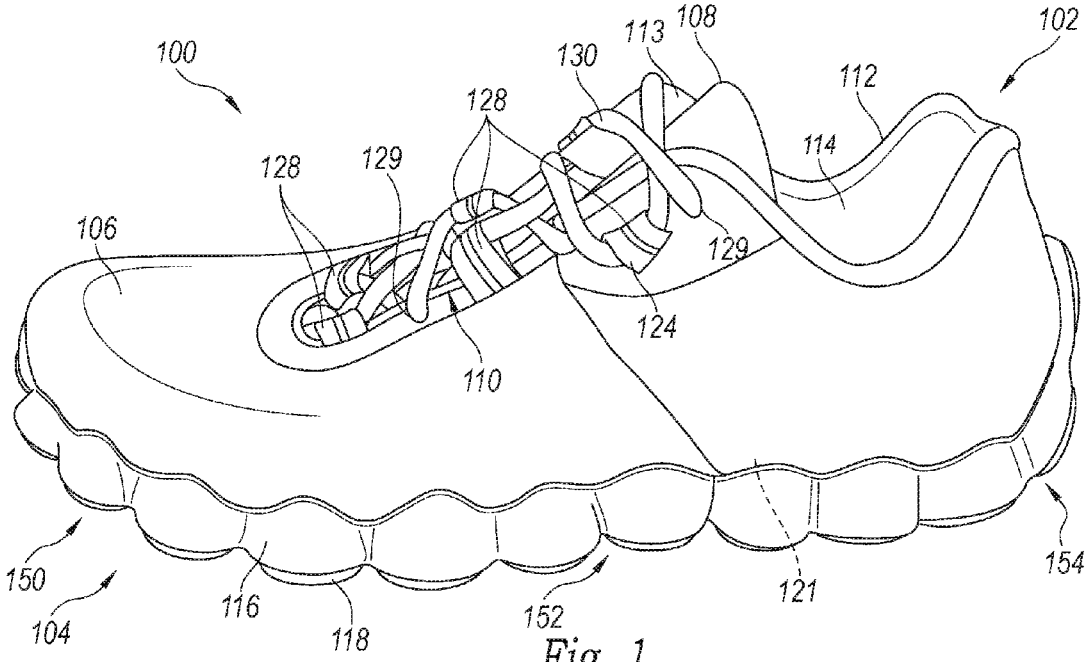
FIG. 1 is a side view of a shoe configured in accordance with an embodiment of the present technology.
Figure 2:
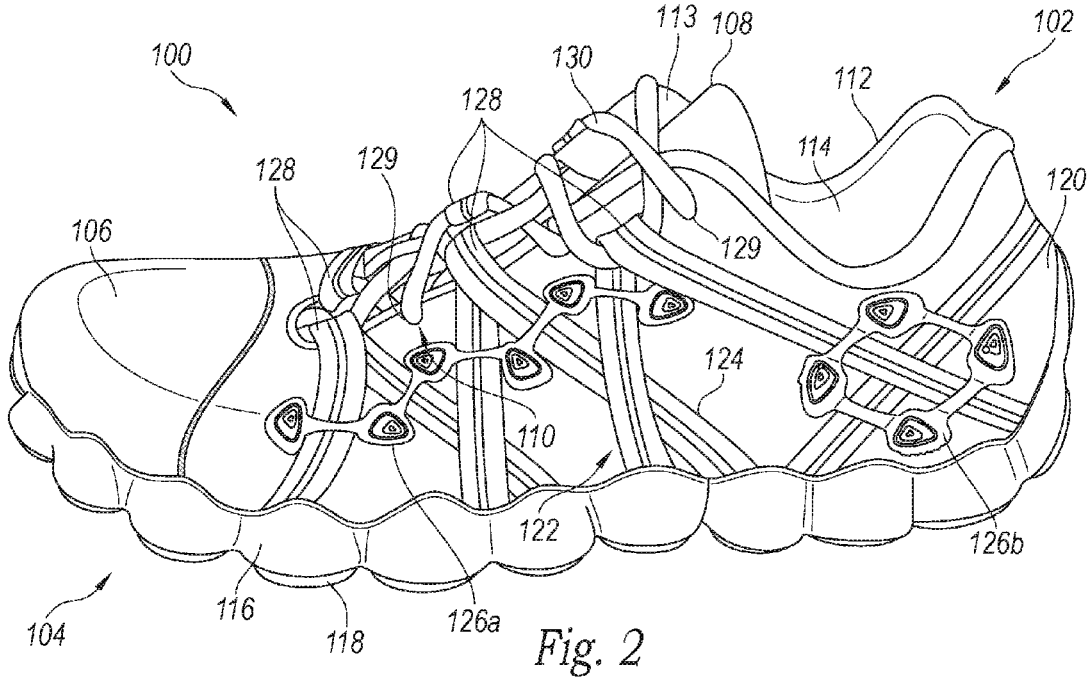
FIG. 2 is a partial cutaway side view of the shoe of FIG. 1 illustrating an upper assembly.

FIG. 1 is a side view of a shoe 100 configured in accordance with an embodiment of the present technology, and FIG. 2 is a partial cutaway side view of the shoe 100 of FIG. 1. As shown in FIG. 1, the shoe 100 includes an upper assembly 102 and a sole assembly 104 attached to the upper assembly 102. The upper assembly 102 can include an exterior layer, referred to as an overlay 106, a tongue 108, and a collar 112. The upper assembly 102 has a throat portion 110 that extends from the vamp or forefoot region of the upper assembly 102 rearward and defines an opening with a first portion 113 that receives the tongue 108 and a second portion 114 through which a foot is received into the interior area of the upper assembly 102.

In FIG. 2, the exterior overlay 106 is shown partially cut away illustrating that the upper assembly 102 further comprises a bootie 120 or bootie layer interior of the overlay 106 and a strapping assembly 122 extending around exterior portions of the bootie 120 between the bootie 120 and the overlay 106 and between the bootie 120 and the sole assembly 104. The bootie 120 can be attached to the overlay 106 along the throat portion 110 (e.g., proximate to the first and second portions 113 and 114 of the opening). The rest of the bootie 120 (i.e., the vast majority of the bootie 120) is at least substantially independent from the overlay 106 such that the bootie 120 is "suspended" within the upper assembly 102 from the throat portion 110. The bootie 120 can therefore hang at least substantially freely from the throat portion 110 and rest atop the sole assembly 104 without being fully fastened to the sole assembly 104. Accordingly, the bootie 120 is independently movable relative to the sole assembly 104 and at least a portion of the exterior overlay 106. The strapping assembly 122 is configured to support and tighten the bootie 120 substantially around the wearer's entire foot at least substantially independent of the overlay 106 and the sole assembly 104.

The overlay 106 of the illustrated embodiment includes one or more layers of material that define the exterior of the upper assembly 102, and is attached to an underlying portion of the sole assembly 104 via adhesive bonding, stitching, and or other suitable attachment methods. The overlay 106 can be made from nylon, cloth, leather, mesh materials, waterproof or water-resistant materials, reflective materials for safety, combinations thereof, and/or other suitable materials for the outer portions of shoes. The bootie 120 can be attached to the overlay 106 along the throat portion 110 proximate to the first and second portions 113 and 114 of the opening using stitches, adhesives, and/or other suitable means for securely attaching the components together. In other embodiments, the bootie 120 and the overlay 106 can be secured together along only a section of the throat portion 110 (e.g., at the collar 112 proximate to the second portion 114 of the opening) or at additional portions of upper assembly 102, such as at the medial or lateral sides of the overlay 106, within the toe box, and/or near the heel region. In these embodiments, the bootie 120 is still substantially "suspended" within the upper assembly 102 atop the sole assembly 104 such that the bootie 120 can move relative to the overlay 106 and to the sole assembly 104.

The bootie 120 is made from one or more layers of suitable for supporting and contacting a runner's foot. For example, the bootie 120 may be made from materials that are soft, breathable (e.g., a mesh material), flexible, waterproof or water-resistant, combinations thereof, and/or other suitable materials. In various embodiments, the bootie 120 can also include one or more padded portions, such as a padded portion at the collar 112 to increase comfort and/or support around the runner's ankle. In certain embodiments, the upper assembly 102 can further include a removable sock liner 121 positioned within the bootie 120 against the underfoot portion to provide a continuous and, optionally, padded support along the bottom of the runner's foot. In other embodiments, the sock liner 121 or a similar supportive structure can be integrated with the bootie 120.

As shown in FIG. 2, the strapping assembly 122 can include one or more straps 124 that wrap around the underside of the bootie 120 in a forefoot region 150, a mid-foot region 152, and/or a heel region 154 of the upper assembly 102. The straps 124 can be made from nylon, cotton, leather, and/or various materials strong enough to bear the load of applied by an athlete's foot as the athlete performs a load-bearing activity (e.g., running, walking, etc.). In the illustrated embodiment, the strapping assembly 122 crosses itself as the strapping assembly 122 extends around the lateral and medial sides and underside of the bootie 120. In other embodiments, the strapping assembly 122 extends around additional portions of the bootie 120 (e.g., proximate to the toe box of the shoe assembly 100, smaller portions of the bootie 120 (e.g., only at the mid-foot region 152), and/or different portions of the bootie 120, and/or the strapping assembly 122 may have a different arrangement extending around the bootie 120 (e.g., in which the strapping assembly 122 does not cross itself) to provide the desired degree of support at the desired portions of the foot substantially independent of the overlay 106.

The strapping assembly 122 or portions thereof are movable relative to the bootie 120 and arranged such that the strapping assembly 122 tightens around the bootie 120 around a foot positioned within the bootie 120. As shown in FIGS. 1 and 2, the strapping assembly 122 is exposed through the overlay 106 along portions of the throat portion 110 adjacent to the tongue 108 such that portions of the strapping assembly 122 form lace loops 128 that receive a shoe lace 130. The lace loops 128 can protrude through openings (e.g., slits) in the overlay 106 as shown in FIG. 1, and/or the lace loops 128 may otherwise be positioned to receive the lace 130. Because the strapping assembly 122 is moveable relative to the bootie 120 and the bootie is largely independent of the overlay 106 and the sole assembly 104, pulling on and tightening the lace 130 across the tongue 108 also pulls on the strapping assembly 122 and tightens the strapping assembly 122 around the bootie 120. This, in turn, tightens or cinches the bootie 120 around the wearer's foot. Accordingly, the strapping assembly 122 can cinch the bootie 120 snugly to the wearer's foot to support the athlete's foot substantially independent of the overlay 106. As further shown in FIGS. 1 and 2, the lace 130 is also coupled to separate eyelets 129 that extend through the overlay 106 and the bootie 120 at the throat portion 110 proximate to the first portion 113 of the opening such that pulling on the lace 130 also pulls the upper edges of the overlay 106 and the bootie 120 closer together over the tongue 108.

As shown in FIG. 2, the strapping assembly 122 can be slideably held in place relative to the bootie 120 by a plurality of alignment retainers (identified individually as a first retainer 126*a* and a second retainer 126*b*; referred to collectively as "the retainers 126"). The retainers 126 can be made from plastic, rubber, and/or cloth materials, and can be attached to the bootie 120 via bonding (e.g., adhesives), stitching, 3-D printing, and/or other suitable attachment means. In various embodiments, the retainers 126 define a plurality of loops or other passages through which the straps 124 of the strapping assembly 122 are laced. This limits or prevents the strapping assembly 122 from moving out of position (e.g., fore and aft and/or upward and downward relative to the bootie 120), while still allowing the straps 124 to slide axially through the retainers 126.

Figure 3:
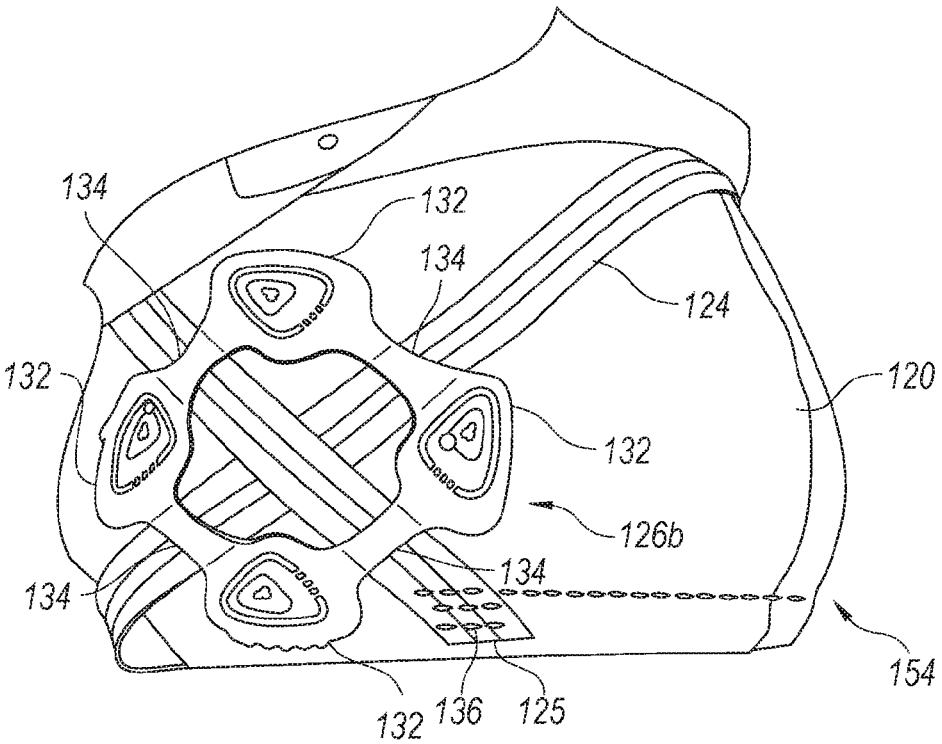
FIG. 3 is an enlarged view of a portion of the upper assembly of FIG. 2.

FIG. 3 is an enlarged view of the second retainer 126*b* of FIG. 2 configured in accordance with an embodiment of the present technology. As shown in FIG. 3, each retainer 126 can include at least two anchor members 132 attached to the bootie 120 and a connecting member 134 extending therebetween to form a loop sized to slideably receive a portion of one or more of the straps 124 of the strapping assembly 122. The spacing of the anchor members 132 can be selected based on the width of the strap 124 positioned therein and a desired or acceptable range of non-axial movement of the strap 124 within the loop. For example, because the strap 124 is free to move (e.g., slide) within the loop, the further apart the anchor members 132 are spaced beyond the width of the strap 124, the higher the degree of potential for upward/downward and/or fore/aft movement of the strap 124.

Each retainer 126 can include a single loop or a plurality of loops. In embodiment illustrated in FIGS. 2 and 3, for example, the second retainer 126*b* includes four interconnected anchor members 132 arranged in a diamond or square pattern at the heel region 154 of the bootie 120, and the first retainer 126*a* includes six interconnected anchor members 132 extending lengthwise along the shoe 100. In other embodiments, the retainers 126 can include more or less interconnected anchor members 132 arranged in a desired configuration to at least substantially retain the strapping assembly 122 in the desired pattern on the bootie 120. In further embodiments, the upper assembly 102 can include a single retainer 126 on the lateral side of the bootie 120, or more than two retainers 126 on the lateral side of the bootie 120. As described in further detail below, additional retainers 126 can be positioned elsewhere on the bootie 120, such as at the underside of the bootie 120, in the heel region 154 of the bootie 120, and/or on the medial side of the bootie 120. In additional embodiments, the retainers 126 can be defined by openings in one or more layers of the bootie 120 itself, and the strapping assembly 122 can be laced through the openings in the bootie 120.

As further shown in FIG. 3, end portions 125 of each strap 124 of the strapping assembly 122 can be secured to the bootie 120 at selected locations, such as in the heel region 154, using stitches 136 and/or other suitable attachment mechanisms. Accordingly, the anchored end portions 125 allow the strapping assembly 122 to cinch around the bootie 120 and the wearer's foot when the wearer tightens the shoe lace 130 (FIGS. 1 and 2) and pulls against the strapping assembly 122. In other embodiments the end portions 125 each strap 124 can be attached to other regions of the bootie 120, one of the retainers 126, and/or another portion of the shoe 100. In further embodiments, the end portions 125 of each strap 124 can be attached to each other such that the strap 124 forms a continuous loop detached from the bootie 120 and held in place with respect to the bootie 120 by the retainers 126.

Figure 4:
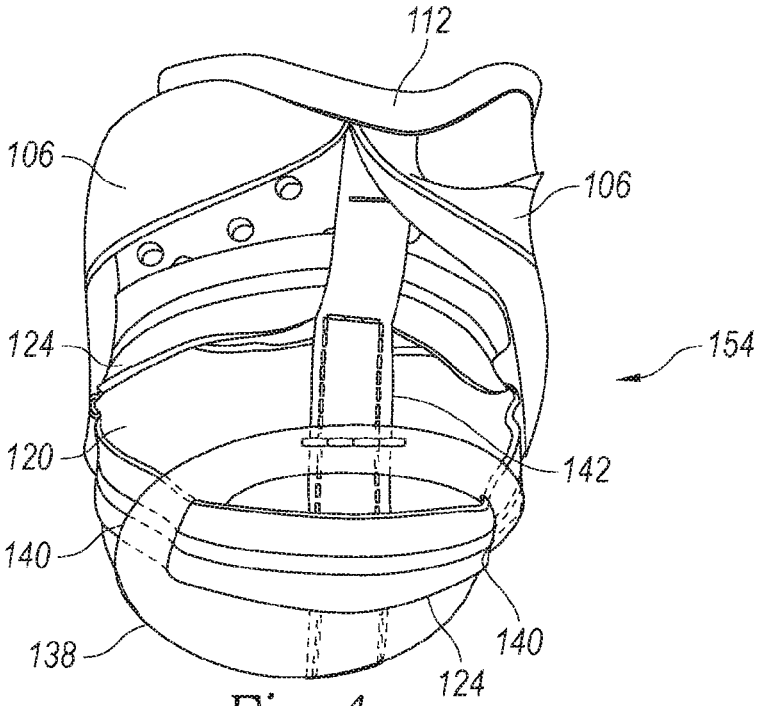
FIG. 4 is a partial cutaway rear view of a heel region of the upper assembly of FIG. 2.

FIG. 4 is a partial cutaway back view of the heel region 154 of the upper assembly 102 configured in accordance with an embodiment of the present technology. In FIG. 4, the overlay 106 has been removed to expose the bootie 120 and an optional heel cup 138 that extends around the heel portion of the bootie 120. The heel cup 138 is configured to receive the heel of an athlete's foot and provide additional support to the bootie 120 in the heel region 154. Accordingly, the heel cup 138 can be made from plastic, a padded material, straps, and/or other suitable materials that can enhance support. The heel cup 138 can be attached to the bootie 120 via bonding, stitching, and/or other suitable attachment techniques. For example, as shown in FIG. 4, a material band 142 (e.g., similar to the straps 124) can extend from the collar 112 around the heel cup 138, and the two can be stitched together to the bootie 120.

In the embodiment illustrated in FIG. 4, the heel cup 138 include a plurality of openings 140 through which the strapping assembly 122 can be threaded. Thus, in certain embodiments the heel cup 138 can define one of the retainers 126 that keeps the strapping assembly 122 in the desired arrangement on the bootie 120. In addition, because the strapping assembly 122 is interwoven with the heel cup 138, tightening the strapping assembly 122 via the lace 130 (FIGS. 1 and 2) can also cinch the heel cup 138 around the calcaneus of the wearer's foot to secure the heel within the bootie 120.

Figure 5:
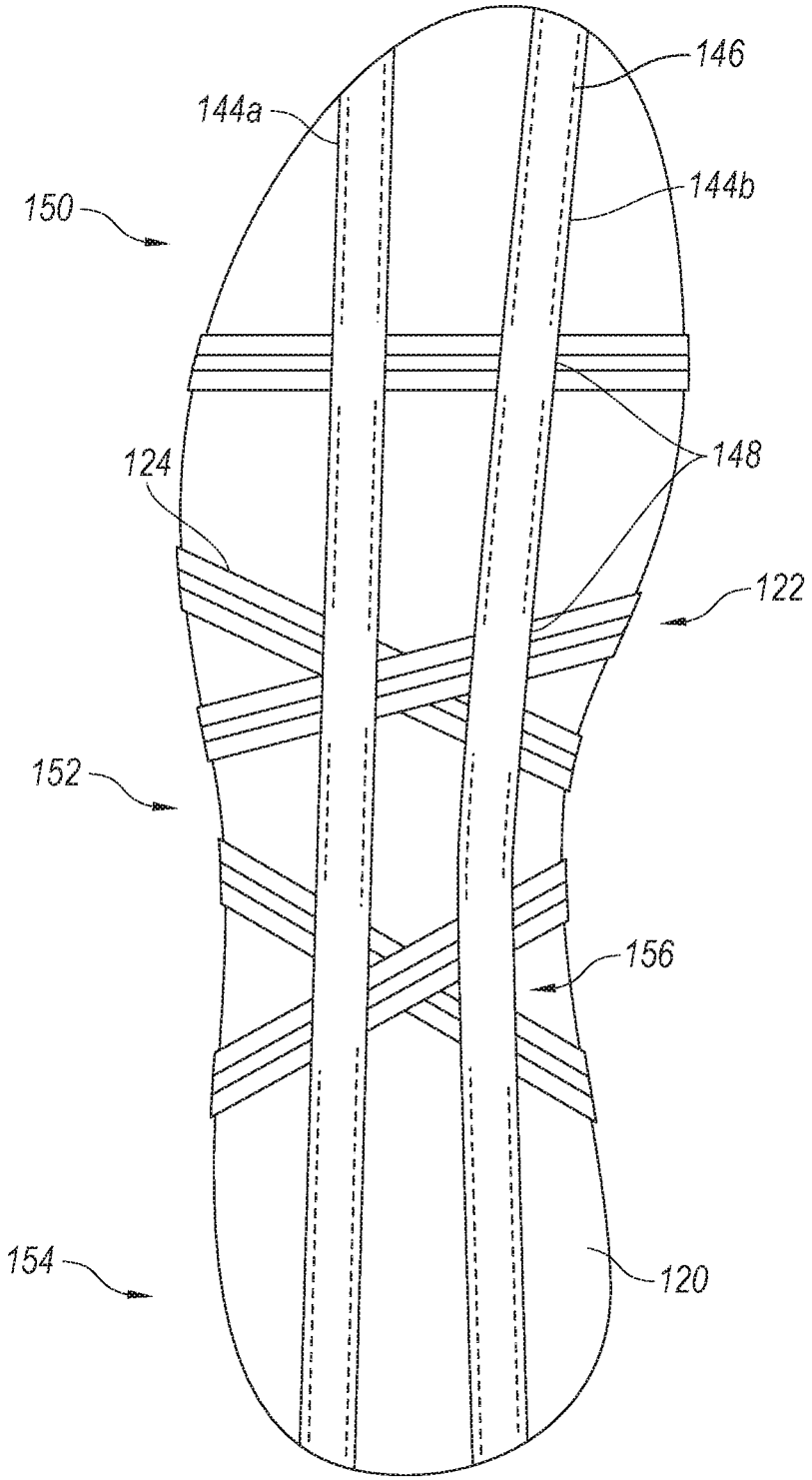
FIG. 5 is bottom view of a bootie of the upper assembly of FIG. 2.

FIG. 5 is bottom view of the upper assembly 102 illustrating an underfoot portion 156 of the bootie 120 configured in accordance with an embodiment of the present technology. In the illustrated embodiment, the strapping assembly 122 is shown extending around the underfoot portion 156 of the bootie 120 at the forefoot region 150 and the midfoot region 152. The strapping assembly 122 crosses itself in the midfoot region 152 to provide additional support for the bootie 120 and facilitate cinching the bootie 120 around the foot. As discussed above, the strapping assembly 122 may also include one or more straps 124 that extend along the underfoot portion 156 in the heel region 154 and/or have a different pattern along the underfoot portion 156.

As shown in FIG. 5, the upper assembly 102 furthers include strap retainers (identified individually as a first retainer 144*a* and a second strap retainer 144*b*; referred to collectively as "the retainers 144") positioned along the underfoot portion 156 of the bootie 120 and configured to slideably secure strap segments in a desired arrangement. Similar to the retainers 126 (FIGS. 2 and 3) on the lateral and medial sides of the bootie 120, the retainers 144 at the underfoot portion 156 of the bootie 120 include one or more loops 148 that slideably receive the strapping assembly 122 and limit the lateral movement of the strap 124 positioned therein. In the embodiment illustrated in FIG. 5, the first and second retainers 144*a* and 144*b* are each made of a band of material (e.g., similar to the strap material and/or the bootie material) attached to the bootie 120 via stitching 146, and the loops 148 are defined by portions not stitched to the bootie 120 so the strapping assembly 122 can slide between the loops 148 and the bootie 120. As shown in FIG. 5, the retainers 144 can extend along the entire length of the underfoot portion 156 (from the forefoot region 150 to the heel region 154), and the loops 148 can be selectively positioned to receive the strapping assembly 122. In various embodiments, the retainers 144 can extend beyond the underside of the bootie 120 around the toe box of the bootie 120 such that first ends of the retainers 144 can be attached proximate to the throat portion 110 (FIGS. 1 and 2), and/or the retainers 144 can extend around the heel of the bootie 120 such that second ends of the retainers 144 can be attached proximate to the collar 112. In this embodiment, the retainers 144 can also serve as an attachment means for coupling the heel cup 138 (FIG. 4) to the bootie 120. In other embodiments, the retainers 144 can extend along shorter segments of the underfoot portion 156 of the bootie 120, can have different configurations (e.g., similar to the retainers 126 of FIGS. 1 and 2), and/or can be attached to the bootie 120 using adhesives and/or other suitable attachment mechanisms. In further embodiments, the upper assembly 102 can include a single retainer 144 on the underside of the bootie 120, or can include more than two retainers 144. The retainers 144 can be substantially flush with the underlying bootie 120 such that the retainers 144 do not form a substantial discontinuity underfoot. This prevents the wearer from feeling the retainers 144 or the strapping assembly 122 through the sock liner positioned within the bootie 121.

Figure 6:
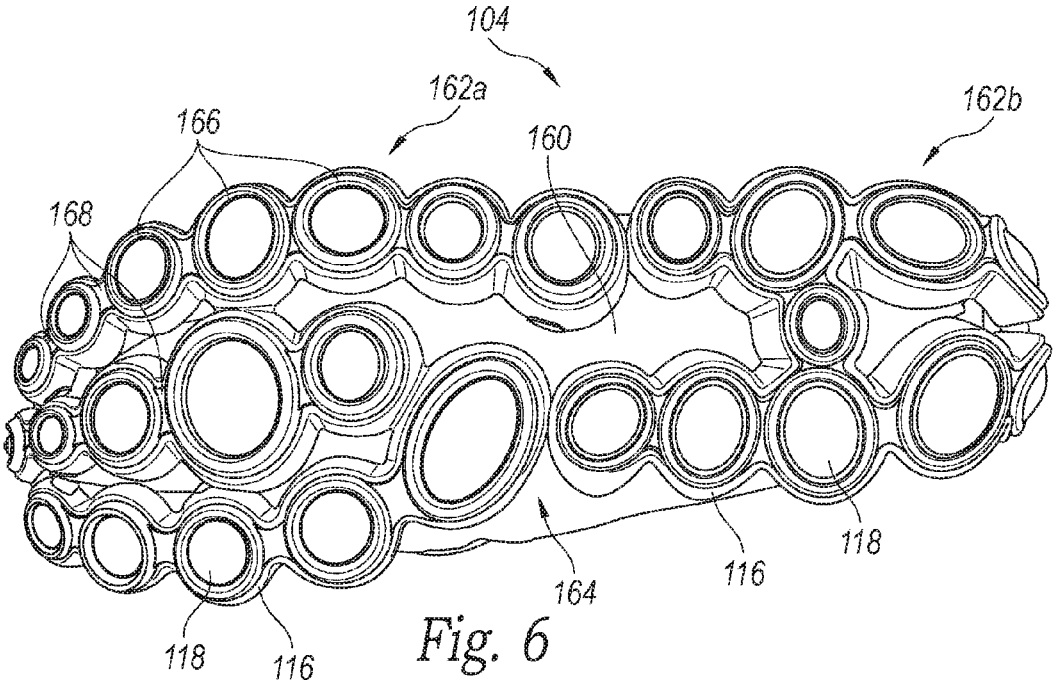
FIG. 6 is a bottom view of a sole assembly of the shoe of FIG. 1.
Figure 7:
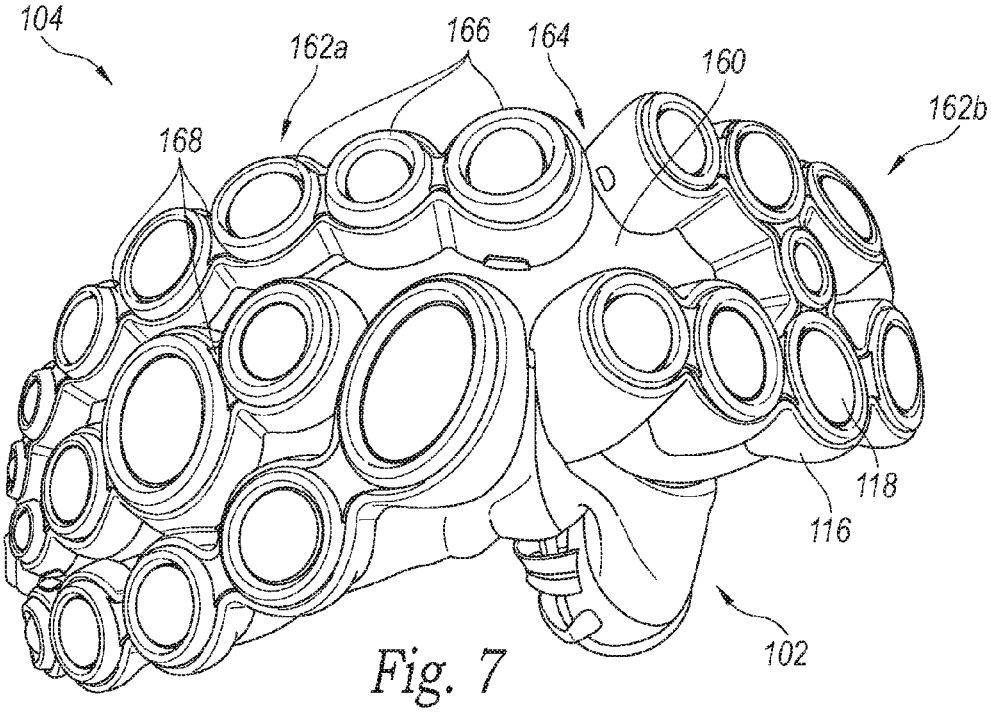
FIG. 7 is an isometric bottom view of the sole assembly of FIG. 6 shown in a flexed position.

FIG. 6 is a bottom view of the sole assembly 104 of FIG. 1 configured in accordance with an embodiment of the present technology, and FIG. 7 is an isometric bottom view of the sole assembly 104 of FIG. 6 shown in a flexed position. As discussed above, the sole assembly 104 includes the outsole 118 attached to the midsole 116. The sole assembly 104 can further include an insole 160 attached between the midsole 116 and the upper assembly 102 (FIGS. 1-5). The insole 160 can be a continuous piece of material (e.g., thermoplastic polyurethane "TPU" plastic) that extends along the entire length of the upper assembly 102 of the shoe 100. In other embodiments, the insole 160 may include a plurality of segments that together provide a substantially continuous longitudinal support for the upper assembly 102.

The midsole 116 can be made from ethylene vinyl acetate (EVA), polyurethane, gel or liquid silicone, polyurethane foam, and/or other suitable midsole materials, and the outsole 118 can be made from rubber, blown rubber, and/or other suitable durable outsole materials. The midsole 116 and the outsole 118 can be molded together or otherwise formed in the desired pattern, and then attached to the insole 160 using bonding, molding, and/or other suitable attachment techniques.

As shown in FIGS. 6 and 7, the midsole 116 and the outsole 118 can together define a first portion 162*a* in the forefoot region 150 of the sole assembly 104 and a separate second portion 162*b* in the heel region 154 of the sole assembly 104. The first and second portions 162*a* and 162*b* can be spaced apart from each other by a space or gap 164. As shown in FIG. 7, this decoupling first portion 162*a* from the second portion 162*b* allows the sole assembly 104 and the shoe 100 as a whole to bend and flex significantly at the gap 164. Accordingly, the decoupled sole assembly 104 can enhance the flexibly of the sole assembly 104 such that the sole assembly 104 can bend and flex to reflect the articulation of the athlete's foot as the athlete moves (e.g., runs, walks, etc.). In other embodiments, the midsole 116 and the outsole 118 can be divided into more than two decoupled portions along the length and/or width of the shoe depending on the desired sole flexibility.

As further shown in FIGS. 6 and 7, the midsole 116 and the outsole 118 can define a plurality of pods 166 joined together by a plurality of interconnect members 168. In the illustrated embodiment, all of the pods 166 of the first portion 162*a* are connected to each other, and all of the pods 166 of the second portion 162*b* are connected to each other and separate from the pods 166 of the first portion 162*b*. Accordingly, the interconnected pods 166 of the first portion 162*a* can function as a single unit, and the interconnected pods 166 of the second portion 162*b* can function as a separate unit.

In the illustrated embodiment, the pods 166 are generally circular and oval, have varying sizes, and are spaced apart by varying distances. In other embodiments, the pods 166 can have different sizes and/or shapes (e.g., squares, rectangles, pentagons, etc.). The sizes, shapes, and/or layout of the individual pods 166 and interconnect members 168 can be selected to provide the desired flexibility, stability, and support in the sole assembly 104 for the shoe 100. For example, different configurations of pods 166 may be selected for different types of activities (e.g., running versus walking) and/or different levels of support (e.g., based on a type of running style). In other embodiments, only portions of the sole assembly 104 can include the podular midsole and outsole 116 and 118. Unlike typical soles with continuous soles extending along the underside of the shoe, the podular sole structure of the sole assembly 104 has a plurality of openings or gaps between the individual pods 166 and the interconnect members 168. These interspaced pods 166 can increase the flexibility of the sole assembly 104 and allow the shoe 100 to more closely reflect the motion of the athlete's foot as the athlete moves. Accordingly, the podular configuration of the midsole 116 and the outsole 118 and the decoupled first and second portions 162*a* and 162 creates a sole assembly 104 with enhanced flexibility.

Figure 8:
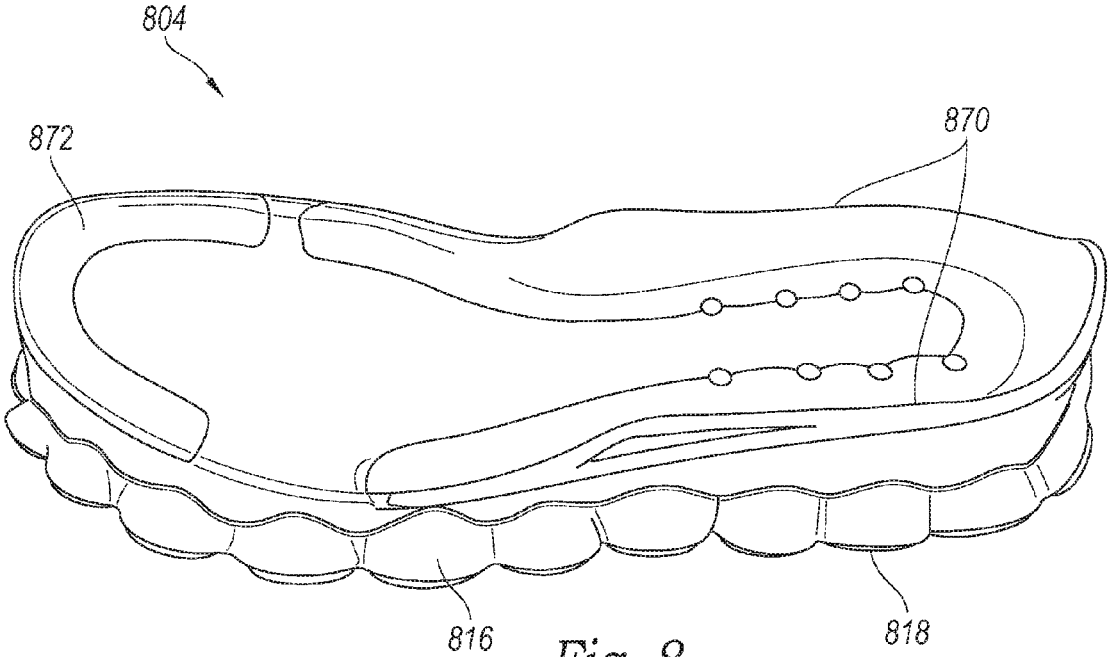
FIG. 8 is a side view of a sole assembly for a shoe configured in accordance with another embodiment of the present technology.

In various embodiments, the sole assembly 104 can include features that increase the stability of the shoe 100. For example, FIG. 8 is a side view of a sole assembly 804 for a shoe (e.g., the shoe 100 of FIGS. 1-7) configured in accordance with another embodiment of the present technology. The sole assembly 804 can include several features generally similar in structure and/or function to the features of the sole assembly 104 described above with reference to FIGS. 1, 2, 6 and 7. For example, the sole assembly 804 includes an insole 860, a midsole 816, and an outsole 818. The midsole 816 and the outsole 818 can together define a plurality of interconnected pods that form a first portion of the sole assembly 804 and a second portion of the sole assembly 804 decoupled from the first portion of the sole assembly 804. As shown in FIG. 8, the midsole 816 can further include a first stability plate or member 870 and a second stability plate or member 872. The first and second stability members 870 and 872 can extend away from the sole assembly 804 toward an upper assembly (e.g., the upper assembly 102 of FIGS. 1-5) and limit medial and/or lateral movement of the foot positioned therein. In the embodiment illustrated in FIG. 8, for example, the first stability plate 870 is substantially U-shaped (e.g., horseshoe-shaped) and extends around the heel region of the sole assembly 804. The second stability plate 872 is also substantially U-shaped and extends around the toe or forefoot region of the sole assembly 804. In other embodiments, the stability plates 870, 872 can have other suitable shapes and arrangement to add medial and lateral stability to the sole assembly 804. In further embodiments, the sole assembly 804 can include only one of the first stability plate 870 and the second stability plate 872, and/or the sole assembly 804 can include additional stability plates to enhance the medial and lateral stability of the sole assembly 804.

Shoes configured in accordance with the present technology are expected to have enhanced comfort and fit, while also being lightweight. The bootie 120 with the strapping assembly 122 described with reference to FIGS. 1-5 can be snugly secured around an athlete's foot. The bootie 120 provides customized support along the bottom and sides of the athlete's foot such that the shoe's support is adjusted to the specific shape of the athlete's foot. The bootie 120 is also adjustable each time the athlete laces the shoe, and can therefor adjust for changes in the foot dimensions (e.g., due to swelling) and/or desired degrees of shoe tightness to provide a customized fit and individualized support. The decoupled sole assembly 104 with the interconnected pods 166 described with reference to FIGS. 6 and 7 can enhance the flexibility of the shoe 100 by allowing the sole assembly 104 to flex and bend in a similar manner as the athlete's foot when the athlete runs, walks, and/or otherwise moves his or her foot. In addition, the stability plates 870, 872 described with reference to FIG. 8 can increase the stability of the shoe 100 by limiting the athlete's medial and lateral foot movement when running or walking. Accordingly, the disclosed shoe construction can provide a customized supportive shoe that is flexible, yet stable, and suitable for running, walking, and/or various other activities.

From the foregoing, it will be appreciated that specific embodiments of the technology have been described herein for purposes of illustration, but that various modifications may be made without deviating from the spirit and scope of the technology. Further, while various advantages associated with certain embodiments of the disclosure have been described above in the context of those embodiments, other embodiments may also exhibit such advantages, and not all embodiments need necessarily exhibit such advantages to fall within the scope of the disclosure.

We claim:

1. A shoe, comprising:

an upper assembly having— an exterior overlay;

a throat portion defining an opening configured to receive a foot; and a bootie attached to the exterior overlay at the throat portion and at least substantially independent of a remaining portion of the exterior overlay, the bootie having a heel region and a midfoot region, and having an underfoot portion;

a strapping assembly comprising at least one strap extending at least partially laterally around the midfoot region and the underfoot portion of the bootie and configured to support the bootie, wherein the at least one strap is movable relative to the bootie;

a heel cup coupled to the heel region of the bootie, wherein the heel cup is configured to receive the at least one strap and the at least one strap extends over a portion of the heel cup; and a sole assembly attached to the upper assembly, wherein the bootie is independently movable relative to the sole assembly and at least a portion of the exterior overlay.

2. The shoe of claim 1 wherein the strapping assembly defines lace loops configured to receive a lace, and wherein the strapping assembly cinches around the midfoot region and the underfoot portion of the bootie when the lace is tightened.

3. The shoe of claim 1 wherein the upper assembly further comprises a plurality of retainers positioned on the bootie, wherein the retainers slideably receive the strapping assembly.

4. The shoe of claim 3 wherein the underfoot portion faces the sole assembly, and wherein the plurality of retainers comprise a plurality of retainers along the underfoot portion of the bootie.

5. The shoe of claim 1 wherein the heel cup receives the heel region of the bootie, and the at least one strap of the strapping assembly extends around the heel region of the bootie.

6. The shoe of claim 1 wherein the at least one strap has first and second end portions, and wherein the first and second end portions are attached to the bootie.

7. The shoe of claim 1, further comprising a plurality of retainers attached to the bootie and configured to slideably receive the strapping assembly, wherein the at least one strap has first and second end portions, and wherein the first and second end portions are attached to each other to form a continuously movable strap held in place by retainer portions.

8. The shoe of claim 1, further comprising a sock liner within the bootie.

9. The shoe of claim 1 wherein the sole assembly comprises a midsole including:

a first stability plate in a forefoot region of the sole assembly; and a second stability plate in a heel region of the sole assembly, wherein the first and second stability plates are configured to provide medial and lateral stability in the forefoot and heel regions of the sole assembly.

10. The shoe of claim 9 wherein:

the first stability plate has a U-shape extending around the forefoot region of the sole assembly; and the second stability plate has a U-shape extending around the heel region of the sole assembly.

11. The shoe of claim 1 wherein the sole assembly comprises:

an insole;

a midsole attached to the insole; and an outsole on the midsole, wherein the midsole and the outsole together define a first plurality of pods in a forefoot region of the sole assembly and a second plurality of pods in a heel region of the sole assembly, and wherein the first plurality of pods are decoupled from the second plurality of pods.

12. The shoe of claim 1 wherein:

at least one strap of the strapping assembly defines lace loops protruding through the exterior overlay and configured to receive a lace, wherein the strapping assembly is configured to cinch around the bootie when the lace is tightened.

13. A shoe, comprising:

an overlay;

a throat portion defining an opening configured to receive a foot;

a bootie attached to the overlay at the throat portion and at least substantially independent from a remaining portion of the overlay;

a strapping assembly having at least one strap extending laterally around the bootie, wherein the strapping assembly is movable relative to the bootie to tighten the bootie around a foot of a wearer; and a plurality of retainers secured to the bootie, wherein the retainers slideably receive the strapping assembly such that the strapping assembly is movable with respect to the bootie and wherein the at least one strap is freely movable through the retainers to tighten or loosen the bootie on a wearer's foot.

14. The shoe of claim 13 wherein the strapping assembly defines lace loops configured to receive a lace, and wherein the strapping assembly tightens around the bootie when the lace is tightened.

15. The shoe of claim 13, further comprising a midsole attached to the overlay, wherein the midsole comprises at least one stability plate configured to provide medial and lateral stability in the forefoot and heel regions of the sole assembly.

16. The shoe of claim 13, further comprising a sole assembly having a forefoot region and a heel region, wherein the sole assembly includes:

an insole attached to the overlay;

a midsole on the insole; and an outsole on the midsole, wherein the midsole and the outsole together define a first portion in the forefoot region and a second portion in the heel region, and wherein the first and second portions are decoupled from each other.

17. The shoe of claim 16 wherein at least one of the first and second portions include a plurality of interconnected pods.

18. A method of making a shoe, the method comprising:

attaching a bootie to a throat portion of an upper assembly of the shoe, wherein the bootie is at least substantially independent from remaining portions of the upper assembly;

positioning a strapping assembly around the bootie, wherein the strapping assembly comprises a strap having a portion extending under the bootie;

forming a plurality of lace loops with the strap; and attaching a sole assembly to the upper assembly, wherein the portion of the strap remains movable under the bootie.

19. The method of claim 18, further comprising positioning the strapping assembly through a plurality of retainers on the bootie, wherein the retainers slideably receive the strapping assembly.

20. The method of claim 19, further comprising:

looping a lace through the plurality of lace loops, wherein the strapping assembly is configured to cinch around the bootie when the lace is tightened.

21. The method of claim 19, further comprising:

attaching a heel cup to a heel portion of the bootie; and lacing the strapping assembly through the heel cup.

22. The method of claim 18 wherein attaching the sole assembly to the upper assembly comprises:

attaching an insole to the upper assembly; and attaching a stability plate to a heel region of the insole, wherein the satiability plate is configured to provide medial and lateral stability in the heel region.

23. The method of claim 18 wherein attaching the sole assembly to the upper assembly comprises:

attaching an insole to the upper assembly; and attaching a stability plate to a forefoot region of the insole, wherein the satiability plate is configured to provide medial and lateral stability in the forefoot region.

24. The method of claim 18 wherein attaching the sole assembly to the upper assembly comprises:

attaching an insole to the upper assembly; and attaching a midsole and an outsole to the insole, wherein the midsole and the outsole together define a first portion in a forefoot region of the sole assembly and a second portion in a heel region of the sole assembly, and wherein the first portion is decoupled from the second portion.

25. The method of claim 24 wherein at least one of the first portion and the second portion comprise a plurality of interconnected pods.

* * * * *